United States Patent [19]

Mattare

[11] Patent Number: 4,932,817

[45] Date of Patent: Jun. 12, 1990

[54] CARGO RETAINER

[76] Inventor: Jackie "Q" Mattare, 23117 Carolvale Ave., Carson, Calif. 90745

[21] Appl. No.: 361,651

[22] Filed: Jun. 5, 1989

[51] Int. Cl.[5] ..... B61D 45/00

[52] U.S. Cl. ..... 410/152; 410/144

[58] Field of Search ..... 410/54, 94, 121, 122, 410/123, 127, 129, 143, 150, 151, 152, 153, 144

[56] References Cited

U.S. PATENT DOCUMENTS

| | | | |
|---|---|---|---|
| 2,414,160 | 1/1947 | Moon | 410/151 |
| 2,467,681 | 4/1949 | McKinney | 410/152 |
| 2,980,037 | 4/1961 | Elsner | 410/144 |

FOREIGN PATENT DOCUMENTS

| | | | |
|---|---|---|---|
| 1209255 | 10/1970 | United Kingdom | 410/144 |

*Primary Examiner*—Andres Kashnikow
*Assistant Examiner*—V. Lissi Mojica
*Attorney, Agent, or Firm*—Chris Papageorge

[57] ABSTRACT

A cargo retainer is disclosed for vehicles having a cargo bin which may include a cargo bed, sidewalls, stanchions and roof structure. The retainer is designed to be used as a pair of retainers which are mounted on opposing sidewalls or between the cargo bed and a suitable roof structure. A beam is securely positioned between the pair of retainers and abuts the cargo preventing undesired movement thereof. The length of the beam is sized in relation to the thickness of the retainers and the spacing between the sidewalls or other suitable structures to provide a tight fit between the sidewalls and the beam and retainers. The retainer includes a rigid box open on two sides which is mounted on a rigid block. The wedge is connected to the block. The wedge has a moveable portion which allows the beam end to be pushed over the wedge surface and into the box after which a wedge portion closes off one side of the box to hold an end portion of the beam in the box. The pair of retainers thus hold both ends of the beam securely between the sidewalls.

20 Claims, 3 Drawing Sheets

CARGO RETAINER

BACKGROUND OF THE INVENTION

The invention relates generally to means for retaining or bracing cargo in cargo bins and more particularly to means for retaining or bracing cargo in vehicles such as trucks, trailers and railroad cars.

Highway traffic or other highway hazards may require sudden braking, quick turning or other emergency maneuver by the operator of a truck trailer. Such maneuvers may cause an improperly secured cargo load to shift quickly. The high momentum resulting from a heavy load shifting when the vehicle is moving at highway speeds can cause the vehicle to tip over or jackknife. Consequently, it is of crucial importance that the cargo retention means used be very effective in preventing undesired cargo movement. Since truck trailer vehicles require the cargo or load to be securely mounted on the trailer to minimize load shifting and prevent undesired movement of the truck trailer combination, the persons loading such vehicles have to spend considerable amounts of time properly placing the cargo in the trailer and tying it down or otherwise securing it to suitable trailer structural components. Many types of cargo retainers have been used but they have typically been difficult to use or require considerable time, effort and skill to properly set up.

Designers of prior art cargo retainers generally believe that the retention means must be large in order to provide safe and secure retention of the cargo, which is often bulky and heavy, in the cargo bin area of the vehicle. Consequently, many prior art cargo retainers are basically support structures for sidewall panelling or tarpaulin covers. An example of such a prior art retainer is disclosed in U.S. Pat. No. 3,811,724 to Woodward. The Woodward device is specifically designed to be used in flat bed trucks and, in one embodiment, has a two piece, vertically slotted stake which fits within sockets at the periphery of the cargo bed. Sidewall panels are inserted between the Woodward stakes and locked in place by means of T-shaped bars which fit in the stake slots. Another Woodward embodiment connects a removable tarpaulin support bow to a pair of telescoping stakes inserted in the sockets. A primary disadvantage of such prior art devices is that the truck or flat bed trailer must have specially constructed stake pockets to accomodate the stake. This can substantially increase the cost of the vehicle. In addition, the particular stakes and cooperating panel structures are somewhat complex and therefore expensive. Moreover, since the supporting sidewall panels can only be positioned at the periphery of the cargo bed, such devices are greatly limited in the dimensional size of the load they can retain.

Some types of prior art cargo retainers are designed to separate and restrain groups of cargo items in a load. Such prior art cargo retainers are generally very limited in their ability to restrain movement of loads of various dimensional sizes. Consequently, the user must have a range of sizes of such devices in order to restrain loads within a range of dimensional sizes. Thus, truckers using such devices must either have many such devices on hand to accomodate a variety of load sizes or they must purchase new devices whenever they find they have a cargo load of a different size to transport. Therefore, such devices tend to be expensive and not very practical for transporting a variety of different types of cargo. Moreover, many such devices may be required to accomodate vehicles of different sizes or dimensions.

Many prior art cargo retainers utilize tie down straps or bands to provide a variable restraint mechanism. An example of such a prior art retainer is disclosed in U.S. Pat. No. 4,219,229 to Ciocan. The Ciocan device incorporates stanchions fitting into appropriately sized and shaped slots in the cargo bed. Once inserted in the slots, each stanchion has special structures thereon which allow a twisting movement of the stanchion to lock the stanchion in the slot. The slots are placed at selected locations on the cargo bed where it is deemed that they will be adjacent or at least proximal the expected cargo load. Thus, in order to accomodate various loads, such prior art devices must have a specially constructed cargo bed with a large number of strategically located slots. This requirement makes use of such prior art devices expensive. In addition, the thinness and narrow width of such tie down straps and bands makes them subject to stretching and breakage particularly with heavy loads. Such prior art tie down systems are thus not able to restrain heavy loads very well. In an attempt to overcome this disadvantage, many users increase the number and vary the placement of the straps and bands. However, this makes use of such systems more troublesome, labor intensive and time consuming. Therefore, such devices not only may require an inordinate amount of labor to set up but may also be of limited effectiveness in securely retaining many cargo loads in the cargo bin.

Other prior art cargo retaining systems use a chain to tie down a load. However, such systems require suitable anchors for attachment of the chain to the vehicle. The anchors are typically welded at suitable locations on or under the truck trailer support structures. But, the costs of affixing these anchors may make such systems inordinately expensive. Moreover, the anchor requirement makes it difficult to reposition the restraint chains at various desired locations in order to properly secure various cargo loads. In addition, proper tightening of all of the chains to ensure adequate cargo restraint may involve undue physical exertion on the part of the user.

A cargo restrainer is thus needed that can be positioned in various locations, as needed to accomodate various load sizes. A cargo restrainer is also needed that is inexpensive to manufacture and utilize and that can be used in various types and sizes of vehicles without requiring the affixation of special support structures on the vehicle.

SUMMARY OF THE INVENTION

It is a principal object of the present invention to provide a cargo retainer which can be positioned at various locations in a cargo bin to accomodate various loads.

It is also an object of the present invention to provide a cargo retainer which can accomodate cargo bins of various dimensions.

It is an object of the present invention to provide a cargo retainer which is inexpensive to manufacture and utilize.

It is an object of the present invention to provide a cargo retainer which is easy to use.

It is another object of the present invention to provide a cargo retainer which can securely retain relatively heavy cargo loads in the cargo bin.

Essentially, the present invention incorporates a base upon which is mounted a box shaped receptacle and a wedge shaped member which is securely connected to the base. The resulting retainer structure is positioned on a cargo bin structure such as a sidewall. Once properly positioned, an end portion of a suitable beam is inserted into the receptacle so that the retainer and beam is secured between opposing sidewalls of the cargo bin.

The beam may either be mounted between a pair of retainers which are mounted on opposing sidewalls or mounted between a single retainer (mounted on a sidewall) at one beam end and a bare sidewall at the other beam end. The tight fit of the retainer and beam between the sidewalls precludes the need for an additional securement means. In addition, the pressure mount feature of the retainer allows it to be positioned at various locations on the sidewalls since no anchors or other special connectors are required. This feature of the invention allows the retainer system to be positioned as close to the cargo as necesary to provide effective retention of the cargo within the cargo bin area.

The wedge of the retainer has a moveable portion which allows the beam to be pushed along the top surface of the wedge so that it effectively moves that wedge portion down so as to open a side of the receptacle. When the beam is moved off the wedge (and concomitantly the force exerted by the beam is removed from the wedge portion), the wedge portion returns to its up position and closes the otherwise open side of the receptacle thereby snugly holding the beam end in the receptacle and precluding the beam from falling out of the receptacle.

In order to remove the beam from the retainer and thereby dismantle the retainer system, the user simply manually pushes the wedge moveable portion into its down position and pulls or pushes the beam out of the receptacle. The retainer may then be simply removed from the sidewall and repositioned elsewhere, if desired.

It is an important feature of the invention that the retainer may be positioned between sidewalls as well as between the roof and cargo bed. In addition, although it is contemplated that in use the invention will be usually positioned between panels having a generally flat surface, the invention may also be positioned between other types of cargo bin structures, such as suitably shaped stanchions.

From the foregoing, it is evident that the retainer of the present invention allows variable positioning of a wood beam secured crosswise between sidewalls to accomodate cargo loads of varying heights and sizes. The retainer may also be installed and removed manually with relative ease requiring no special tools to set up and requiring no special anchors or other attachment means. Consequently, the retainer of the present invention may be used on a variety of different types of truck trailers and other vehicles having cargo bins with suitable support structures.

DETAILED DESCRIPTION OF THE PREFERRED EMBODIMENT

Figure 1:
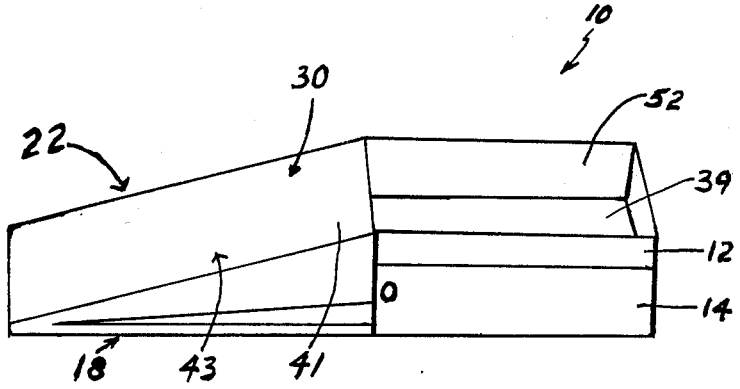
FIG. 1 is a perspective view of the cargo retainer of the present invention.
Figure 2A:
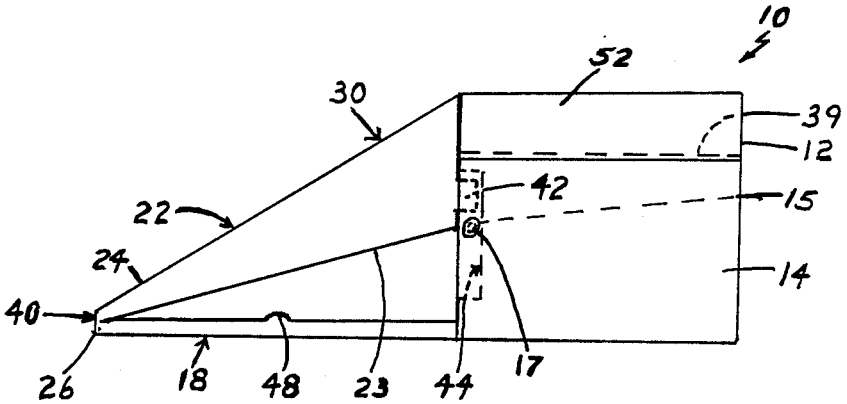
FIG. 2*a* is a side elevational view of the cargo retainer of the present invention showing the moveable portion of the wedge in an up position.
Figure 2B:
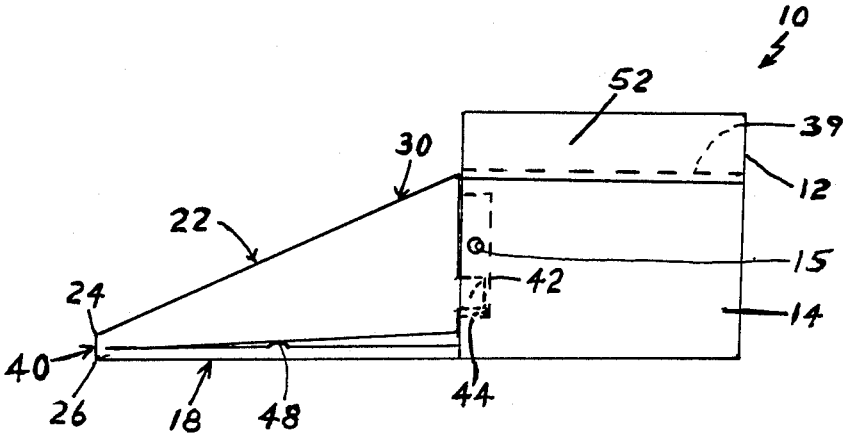
FIG. 2*b* is a side elevational view of the cargo retainer of the present invention showing the moveable portion of the wedge in a down position.

Referring now to the drawings, the cargo retainer of the present invention is generally designated by the numeral 10. The cargo retainer 10 preferably includes a box or other type of receptacle 12, which is preferably generally rigid. Receptacle 12 is preferably securely mounted on a base or block 14 which provides a firm foundation for the receptacle 12. Receptacle 12 preferably has two open sides, as shown. A wedge 16 is connected to the base 14, as shown in FIGS. 2*a* and 2*b*. However, wedge 16 may also be connected to receptacle 12 if receptacle 12 is suitably dimensioned. Wedge 16 preferably includes a first member 18 situated preferably at a lower portion of the wedge 16. First member 18 is connected at an end thereof to the base 14. Member 18 is preferably firmly connected to bas 14 to provide enhanced structural strength to the retainer 10. Wedge 16 also preferably includes a second member 22 connected at an end 24 thereof to preferably the other end 26 of the first member 18. Second member 22 also has another end 28 which is free and unconnected. Free end 28 is generally adjacent the receptacle 12. Second member 22 has a moveable portion (or upper portion) 30 which preferably includes end 28. Moveable portion 30 is preferably moveable between a first position (or up position) as shown in FIG. 2*a* and a second position (or down position) as shown in FIG. 2*b*. In the up position, the end 28 which is approximately adjaent receptacle 12 preferably provide another (fifth) side for the receptacle 12 thereby generally closing one otherwise open side 20 of the receptacle 12, as shown in FIG. 2*a*. Consequently, when the portion 30 is in the up position, receptacle 12 is open at only its top side. In the down position, end 28 of moveable portion 30 does not block the open side 20 of receptacle 12. Consequently, in the down position, receptacle 12 has two sides which are generally open. Optionally, instead of only the moveable portion 30 being moveable, the entire second member 22 may be moveable (about its connection point to the first member 18) between the first and second positions.

The cargo retainer 10 is preferably used in conjunction with a beam 32. An end portion 34 of beam 32 preferably generally snugly fits within receptacle 12 and is firmly held therein when the portion 30 is in the up position resulting in the receptacle 12 in conjunction with end portion 28 of second member 22 generally enclosing the beam end portion 34.

Figure 5:
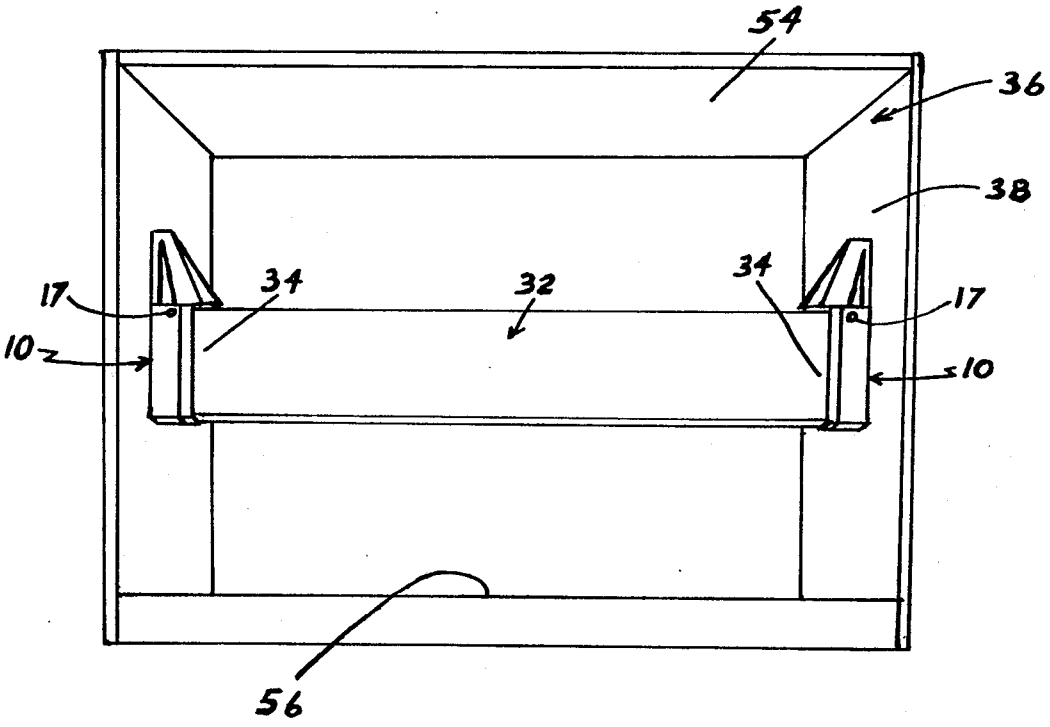
FIG. 5 is a perspective view of a pair of cargo retainers mounted on opposing sidewalls and utilizing a beam secured therebetween.

When properly installed in cargo bin 36, there are preferably a pair of retainers 10 utilized, as shown in FIG. 5. One of the pair of retainers 10 is mounted on one of the sidewall panels 38 (or other suitable cargo bin structures such as stanchions, for example), and the other of the pair of retainers 10 is mounted on an opposing one of the sidewall panels (or sidewalls) 38. The beam 32 is moved into position in the receptacles 12 of retainers 10 by simply sliding the end portion 34 over the surfaces of the moveable portions 30. Since the length of the beam 32 is preferably sized relative to the thickness of the base and receptacle 12 as well as the spacing between the opposing sidewall panels 38, sliding beam 32 over the moveable portions 30 of the wedges 16 exerts a force on the moveable portions which moves these portions into their down position allowing ingress of the beam ends 34 into the receptacles 12. The second member 22 preferably has an upper surface 41 which is generally flat to allow the beam end portion to slide more easily on the second member. Since the beam is preferably slightly longer than the spacing between the opposing sidewalls minus the thickness of the bases and receptacles floors 39, it exerts a force on the floors 39 of the receptacles 12, the bases 14 and the opposing sidewalls 38 which tends to spread apart the opposing sidewalls. This force acts to secure beam 32 and retainers 10 in the desired positions on the sidewalls. Once in the receptacles 12, the moveable portions revert to the up position thereby closing off the open side 20 and preventing egress of the beam ends from the receptacle 12. Thus, the beam ends are firmly held in the receptacles 12 and cannot fall out. Although it is preferred that the beam be positioned between a pair of retainers 10, the beam 32 may alternatively be positioned between a single retainer 10 mounted on one of the sidewalls 38 and another opposing one of the sidewalls 38 if the sidewall is suitably shaped to accomodate the beam end portion. In addition, the beam 32 and retainer 10 (or retainers 10) may also be positioned between the roof 54 and cargo bed 56 of the cargo bin 36, if desired.

Retainer 10 is preferably provided with a resilient means which both tends to move the moveable portion 30 into its up position in the absence of forces (other than the resilient means) acting on the moveable portion and which also allows movement of the moveable portion into its down position when desired forces (particularly the force exerted by the beam 32) are acting on the moveable portion. This resilient means is preferably a portion 40 of the wedge (preferably of the second member 22) which is flexible to yield to the force exerted by the beam 32 when it is slid over the second member's moveable portion and which is also composed of a material having memory so as to return to its original desired position (preferably resulting in the moveable portion 30 returning to its up position) in the absence of external forces acting on the moveable portion. The flexible portion 40 is preferably composed of a flexible plastic material having the desired flexibility and memory. Thus, the flexible plastic material allows the flexible portion to bend when the beam 32 is being slid over the moveable portion 30 so as to allow the moveable portion to move into its down position and allows the flexible portion 40 to return to its original shape when the beam is removed from the moveable portion so that the moveable portion pops back up into its u position after the beam end portion 34 is in the receptacle 12. Alternatively, however, the resilient means may simply be a spring mounted at the interconnection of the first and second members and connected at one end to the first member 18 and connected at the other end to the second member 22 or the moveable portion 30.

Although it is preferred that the first and second members 18 and 22, the receptacle 12 and the base 14 be integral, they may also be separate members which are connected together as described hereinabove. It is also preferred that the upper surface 41 of second member 22 (or the entire upper surface 43 of the second member 22) is inclined relative to the floor 39 of the receptacle 12 to facilitate entry of the beam 32 into the receptacle 12. The length and angle of inclination of the upper surface 43 of the second member 22 may be selected to accomodate the length of the beam 32 relative to the sidewall spacing and thicknesses of the base 14 and receptacle floor 39. Thus, if it is desired that the beam 32 exert a relatively higher force on the retainers 10 and sidewalls 38, a longer second member 22 with a smaller angle of inclination may be utilized to make it easier to push (or pull) the beam 32 along the surfaces 43 of the second members and into the receptacles.

Figure 3:
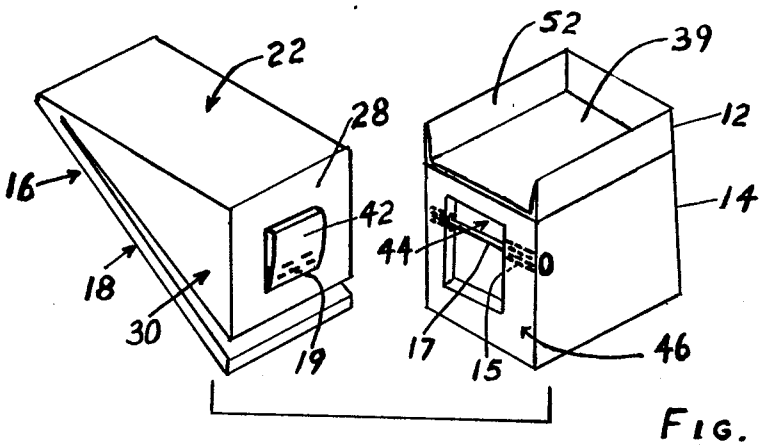
FIG. 3 is an isometric view of the cargo retainer depicting the wedge separated from the receptacle and base to illustrate the pin and hole movement limiting means.
Figure 4:
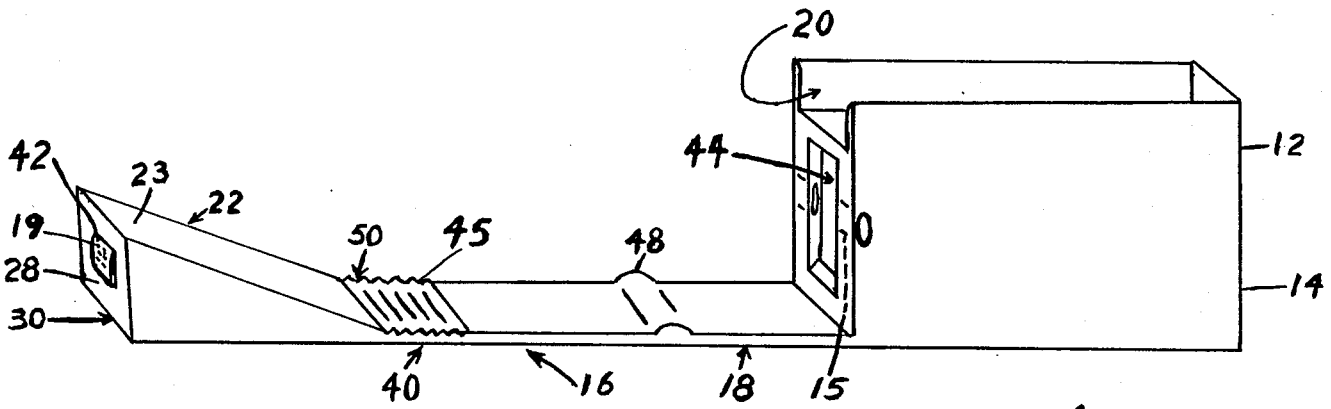
FIG. 4 is an isometric view of the cargo retainer in which the components are integral and depicting the wedge straightened out to illustrate the flexible portion of the wedge which allows movement of the upper portion of the wedge.

It is preferable that the entire retainer 10 be composed of a plastic material which is preferably structurally strong yet flexible with the flexible wedge portion 40 having a sawtooth shape at preferably its inner surface 50 to provide enhanced strength as well as flexiblity to member 22. The flexible portion may be configured so that the sawteeth 45 contact each other when the moveable portion 30 is in the desired down position thus acting as a stop or means for limiting downward movement of the moveable portion. Preferably, the means for limiting movement of the moveable portion includes a pin 42 in the second member 22 preferably at the end portion thereof and a hole 44 in an end portion 46 of the base (or alternatively the receptacle). The hole 44 receives the pin 42 therein and allows the pin 42 a range of movement (preferably in an up and down direction corresponding to the direction of movement of the moveable portion 30) which is selected to provide the moveable portion 30 with the desired range of movement between the up and down positions. In addition, there is preferably a ridge or bump 48 on an upper surface of the first member 18 which contacts the under surface 23 of the second member 22 when the moveable portion is at the lower boundary limit of its desired range of movement corresponding generally to the down position. The ridge 48 thus provides an additional limit on the movement of the moveable portion. Additionally (or alternatively), the means for limiting movement of the moveable portion 30 includes a bar 17 (shown in FIG. 2*a*, 3 and 5) and an aperture 15 (shown in FIGS. 1, 2*a*, 2*b*, 3 and 4) which is preferably located in a generally medial portion of the block 14 and preferably disposed generally latitudinally therein so that it is just underneath the pin 42 when moveable portion is in its up position (as shown in FIG. 2*a*). This allows bar 17 to be inserted in aperture 15 when beam 32 is in the receptacle 12 and be positioned generally adjacent the pin 42 or abut the pin 42 thereby preventing downward movement of the moveable portion into or toward its down position. Thus, bar 17 and aperture 15 act to prevent beam 32 from falling out of the receptacle 12. Another aperture 19 (shown in FIGS. 3 and 4) in pin 42 of moveable portion 30 may be provided and preferably aligned with aperture 15 to allow bar 17 to be inserted in both aperture 15 and aperture 19 thereby directly preventing movement of moveable portion 30 to provide enhanced securement of beam 32 in receptacle 12. Bar 17 is preferably an 8 penny nail commonly available to truckers and cargo handlers in provide easy component availability to users of the retainer 10 of the present invention.

The dimensions of the retainer may be selected to provide maximal structural strength thereto taking into consideration the convenience a compact cargo retainer affords. The dimensions are also dependent on the materials used to manufacture the retainer. The height of the receptacle walls 52 may, for example, be one inch to provide snug securement of the beam end in the receptacle. However, the height may vary from this value depending on the size of the beam utilized and the desired application for the retainer. In addition, the receptacle 12 may be generally rectangular to accomodate a standard size 4×2 wood beam or generally square to accomodate a standard size 4×4 wood beam. However, the receptacle may also be arcuate or have other shapes to accomodate suitable beams having various other shapes. The use of a standard size 4×4 or 4×2 wood beam allows the use of a commonly available beam 32 with the retainer 10. The use of such a wood beam also allows the beam 32 to be relatively easily cut to the desired length.

Accordingly, there has been provided, in accordance with the invention, a cargo retainer for retention of cargo within a desired cargo area that fully satisfies the objectives set forth above. It is to be understood that all terms used herein are descriptive rather than limiting. Although the invention has been described in conjunction with the specific embodiment set forth above, many alternative embodiments, modifications and variations will be apparent to those skilled in the art in light of the disclosure set forth herein. Accordingly, it is intended to include all such alternatives, embodiments, modifications, and variations that fall within the spirit and scope of the invention as set forth in the claims hereinbelow.

I claim:

1. A cargo retainer for a cargo bin, comprising:

a block;

a box mounted on said block, said box having two open sides;

a first member secured to said block;

a second member connected to said first member, at least an upper portion of said second member being moveable relative to said box between a first position allowing ingress of a beam end portion into said box and a second position impeding egress of the beam end portion from said box so that said beam may be firmly secured between desired cargo bin structures in order to retain cargo within the cargo bin.

2. The retainer of claim 1 wherein said second member is at least partially composed of a flexible material to allow said second member to bend under pressure so that said upper portion thereof may thereby be moved from the second position to the first position and to allow said upper portion of said second member to return to the second position upon release of the pressure.

3. The retainer of claim 1 further including a resilient means connected to said upper portion and to said second member for urging said second member into the second position.

4. The retainer of claim 1 wherein said second member has an end portion adjacent said box, said end portion closing one open side of said box when said second member is in the second position to hold the end portion of the beam in said box.

5. The retainer of claim 1 wherein the upper surface of said second member is generally flat to allow the beam to slide along the upper surface to facilitate ingress and egress of the beam into said box.

6. The retainer of claim 1 wherein the upper surface of said second member is generally flush with a floor portion of said box when said second member is in the first position in order to facilitate ingress and egress of the beam into and out of the box.

7. The retainer of claim 1 wherein said box and said block are integral.

8. The retainer of claim 1 wherein said first member and said second member are integral.

9. The retainer of claim 1 wherein said box, said block, said first member and said second member are integral.

10. The retainer of claim 1 wherein said box is selectively dimensioned, in proportion to the beam, to provide a snug fit of the beam end portion within said box when said second member is in the second position so that said box may securely hold the beam end portion therein.

11. The retainer of claim 10 wherein the beam is a generally standard size four by two wood board.

12. The retainer of claim 1 wherein said block has a lower surface which is selectively shaped to accomodate the shape of the cargo bin structures so that said block may be securely mounted on at least one of said cargo bin structures when the beam end portion is held in said receptacle and positioned between said cargo bin structures.

13. The retainer of claim 1 further including a means for limiting movement of said second member relative to said first member to a range the outer boundary limits of which are defined by the first position and the second position.

14. The retainer of claim 13 wherein said means for limiting movement includes:

a pin mounted in said first member; and said second member having a hole receiving said pin, said pin and the hole being selectively dimensioned relative to each other so that said pin has a desired range of movement within the hole.

15. A cargo retainer for a vehicle having a cargo bin, comprising:

a base;

a receptacle for receiving an end portion of a beam positioned between opposing walls of the cargo bin, said receptacle mounted on said base, said receptacle having two open side portions;

a wedge having a lower end portion secured to said base and an upper portion an upper surface portion of which is inclined relative to a floor portion of the receptacle to facilitate ingress and egress of the beam into and out of said receptacle, said wedge being at least partially composed of a flexible material so that said upper portion is moveable relative to said receptacle between a first position in which said upper portion closes one open end portion of said receptacle so that said receptacle can securely hold the beam therein and a second position in which said upper surface portion is generally flush with a floor portion of said receptacle to facilitate ingress and egress of the beam into and out of said receptacle.

16. The retainer of claim 15 wherein the beam has a selected length to accomodate the thickness of a floor of said receptacle, the thickness of said base and spacing between opposing walls of the cargo bin to provide a desired tight fit of the beam and the retainer between the opposing walls so that the beam exerts pressure against the opposing walls in order to secure the beam between the walls when the beam is positioned therebetween and held in said receptacle.

17. The retainer of claim 15 wherein said wedge is at least partially composed of a flexible material having memory to allow said upper portion to be moved into the second position under pressure of a beam slid along said upper portion and to allow said upper portion to return to the first position upon cessation of the pressure of the beam.

18. The retainer of claim 15 wherein said base, said block and said wedge are integral.

19. The retainer of claim 15 wherein said receptacle is selectively dimensioned to allow the end portion of the beam to snugly fit therein.

20. The retainer of claim 19 further including a means for limiting movement of said upper portion between the first position and the second position, said means connected to said wedge and said block.

* * * * *